US011040569B1

(12) United States Patent
Ferlet

(10) Patent No.: US 11,040,569 B1
(45) Date of Patent: Jun. 22, 2021

(54) PAINT BRUSH HOLDER

(71) Applicant: Rebecca A. Ferlet, Corsicana, TX (US)

(72) Inventor: Rebecca A. Ferlet, Corsicana, TX (US)

( * ) Notice: Subject to any disclaimer, the term of this patent is extended or adjusted under 35 U.S.C. 154(b) by 0 days.

(21) Appl. No.: 16/290,192

(22) Filed: Mar. 1, 2019

(51) Int. Cl.
*B44D 3/12* (2006.01)
*A46B 17/08* (2006.01)

(52) U.S. Cl.
CPC ..... *B44D 3/123* (2013.01); *A46B 17/08* (2013.01)

(58) Field of Classification Search
CPC ..... B44D 3/123; B44D 3/12; B44D 3/121; B44D 3/125; A46B 17/08
See application file for complete search history.

(56) References Cited

U.S. PATENT DOCUMENTS 2,566,877 A * 9/1951 Dunton ..... B44D 3/123 220/736
3,948,413 A * 4/1976 Gorrell ..... B44D 3/123 220/696
4,014,453 A * 3/1977 Tarnacki ..... B44D 3/123 220/697
D285,778 S 9/1986 Smith
4,854,470 A * 8/1989 Ireland ..... B44D 3/123 220/697
6,446,829 B1 9/2002 Malvasio et al.
6,863,191 B2 3/2005 Kesling
7,383,847 B2 6/2008 Clark
7,726,510 B2 6/2010 Bootz
8,286,790 B1 10/2012 McBryar
8,439,054 B2 5/2013 Rhines
9,572,420 B1 2/2017 Morris

* cited by examiner

*Primary Examiner* — Don M Anderson
(74) *Attorney, Agent, or Firm* — Cramer Patent & Design, PLLC; Aaron R. Cramer

(57) ABSTRACT

A paint brush holder has a hinged tray with a plurality of apertures disposed within a base capable of being vertically supported within an interior of a can of paint. The tray is both braced and secured into position by a pair of support arms.

9 Claims, 5 Drawing Sheets

PAINT BRUSH HOLDER

FIELD OF THE INVENTION

The presently disclosed subject matter is directed to a paint brush holder.

BACKGROUND OF THE INVENTION

All of us know of the burdens, difficulty and painstaking patience required when performing a painting project. While preparations and material are important, the most common tool used in the painting process is that of the paintbrush. While the common paintbrush has existing for generations, it does not mean that it is not without its faults. Perhaps the biggest problem is where to place the brush, when covered in paint, yet not in use.

Such times may occur when the painter is taking a break, answering a phone call, or grabbing something to eat. Many places the brush over the rim of the can whereupon the excess paint drips down the side of the can, thus adding to cleanup duties. Others may place it upon a drop cloth, where a puddle of paint forms that the painter must avoid stepping in to avoid further compounding the mess. All these solutions not only waste paint but end up putting the paint in the waste stream where they can cause environmental concerns. Accordingly, there exists a need for a means that allows for paint brushes being actively used for painting, can be temporarily stored without the disadvantages as described above. The development of the brush holder for paint can fulfills this need.

SUMMARY OF THE INVENTION

The principles of the present invention provide for a brush holder for a paint can, comprises a "U"-shaped frame made of a forward stop—the frame provides a holding cavity for holding a paint brush in an upright condition; a bottom grated surface over the paint can such that excess paint drips back into the paint can; a curved rear support having an upper surface—the upper surface is provided with a rolled edge to allow for easy insertion and removal of a paint brush; a rear brace connected to a rear side of the curved rear support via a hinge assembly—the rear brace provides additional stability to the frame when the brush holder is placed atop an open can of paint; a plurality of bristles each having a tip positioned at a junction of the forward stop and the grated surface and a ferrule of each the bristles positioned such that it contacts the curved rear support and remains in place via friction and gravity.

The grated surface may be provided with multiple open slots that allow any excess paint within the holding cavity formed by the curved rear support and the forward stop to return the paint can via gravity. The paint brush may be equal or slightly larger than the width of the frame. The upper surface of the curved rear support is provided with a rolled edge to allow for easy insertion and removal of a paint brush. The rolled edge is to wipe excess paint off of the paint brush after dipping the bristles in the paint. The curved rear support with respect to the paint is defined by a displacement angle and is controlled by an adjustment mechanism. The adjustment mechanism is envisioned to include a center mounted adjustment arm, a sliding track and multiple adjustment stops.

The excess paint that is removed will flow down the curved rear support contacting a grated surface and transition into dripping paint to flow through the open slots of the grated surface and return to the paint. The hinge assembly may use a pin, a piano hinge mechanism, a flexible plastic area, or other similar means to produce motion. Before placing on the paint can, the brush holder adjusts the center mounted adjustment arm within the sliding track by sliding it along a travel path and engaging a distal end of the center mounted adjustment arm within one of the adjustment stops. The brush holder is made of plastic from an injection molding process which may require a custom mold. The brush holder provides for easy cleanup whether used with soap and water or with a solvent in the case of oil-based paints. The paint can may be one gallon while the forward stop may be two and a half inches tall. The bottom grated surface may be one-half inch deep. While the curved rear support is three and three-quarters inches tall. The forward stop may be four inches wide. The bottom grated surface may be four inches wide. While the curved rear support may be four inches wide.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
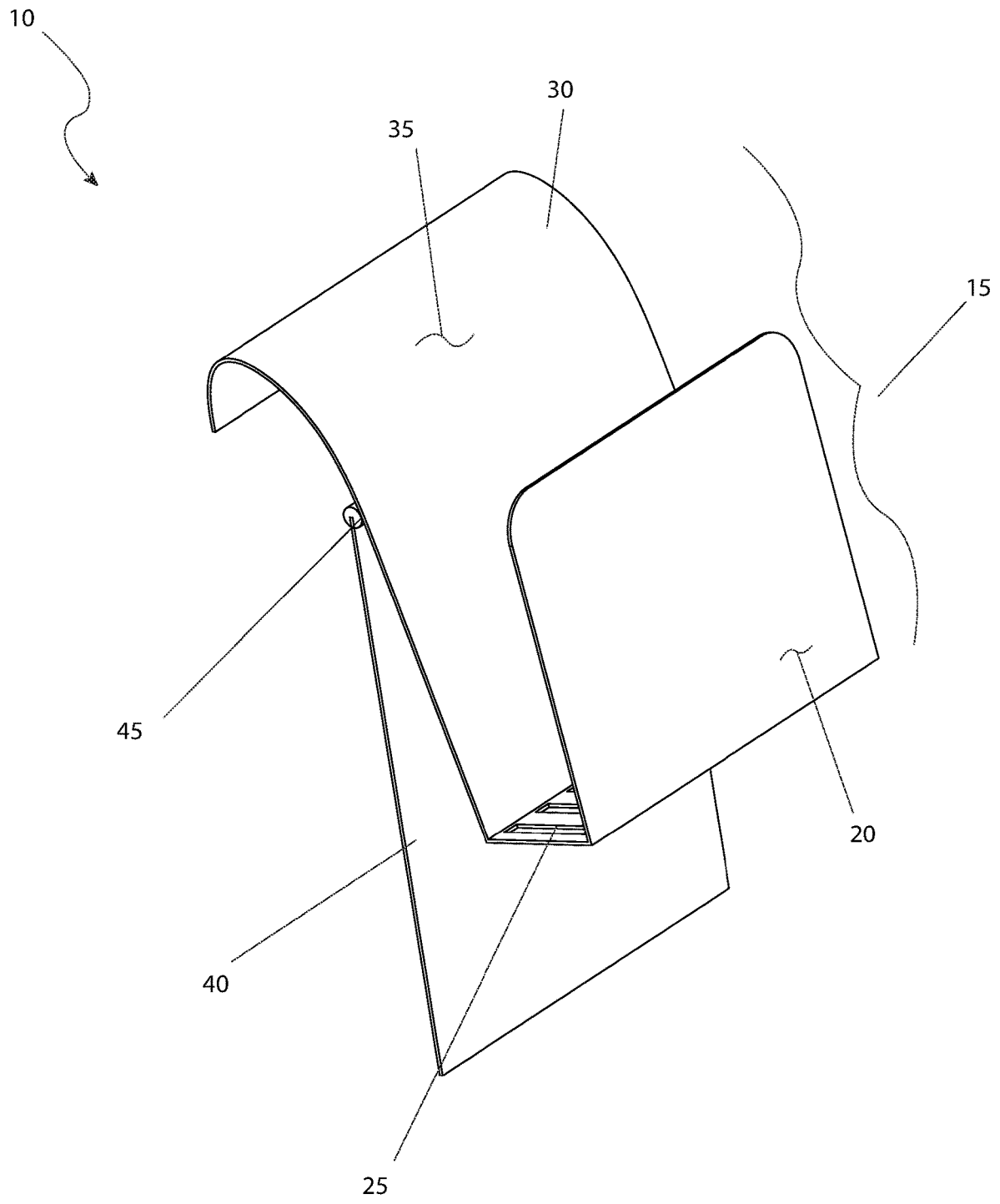
FIG. 1 is a perspective view of the brush holder 10 for a paint can 50, according to the preferred embodiment of the present invention.

10 brush holder
15 frame
20 forward stop
25 grated surface
30 curved rear support
35 holding cavity
40 rear brace
45 hinge assembly
50 paint can
55 rim
60 side surface
65 paint
70 displacement angle "a"
75 adjustment mechanism
80 open slot
85 rolled edge
90 travel path "t"
95 paint brush
100 bristles
105 ferrule
110 dripping paint
115 displacement angle "d"
120 center mounted adjustment arm

125 sliding track
130 adjustment stop
135 travel path "x".

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the brush holder 10 for a paint can 50, according to the preferred embodiment of the present invention is disclosed. The brush holder 10 (herein also described as the "device") 10, comprises primarily of a "U"-shaped frame 15 made of a forward stop 20, a bottom grated surface 25 and a curved rear support 30. The overall size of the device 10 will vary per size of paint can 50 upon which it is used. However, for a typical one gallon (1 Gal) paint can 50, the forward stop 20 would be approximately two and a half inches (2½ in.) tall, the bottom grated surface 25 would be approximately one-half inch (½ in.) deep, and the curved rear support 30 would be approximately three and three-quarters inches (3¾ in.) tall. All three (3) components (the forward stop 20, the bottom grated surface 25, and the curved rear support 30) would be approximately four inches (4 in.) wide. As noted these dimensions are for reference only and are not intended to be a limiting factor of the present invention.

The frame 15 provides a holding cavity 35 for the purposes of holding a paint brush 95 in the upright condition as will be described in greater detail herein below. A rear brace 40 is connected to the rear side of the curved rear support 30 via a hinge assembly 45. The rear brace 40 provides additional stability to the frame 15 when the device 10 is placed atop an open can 50 of paint 65. Further description on the utilization of the device 10 will be provided herein below. All of the components utilized in the device 10 would be made of plastic in an injection molding process. Such a process would require the design and use of custom molds. The material of construction provides for easy cleanup whether used with soap and water or with solvents in the case of oil-based paints 65.

Figure 2:
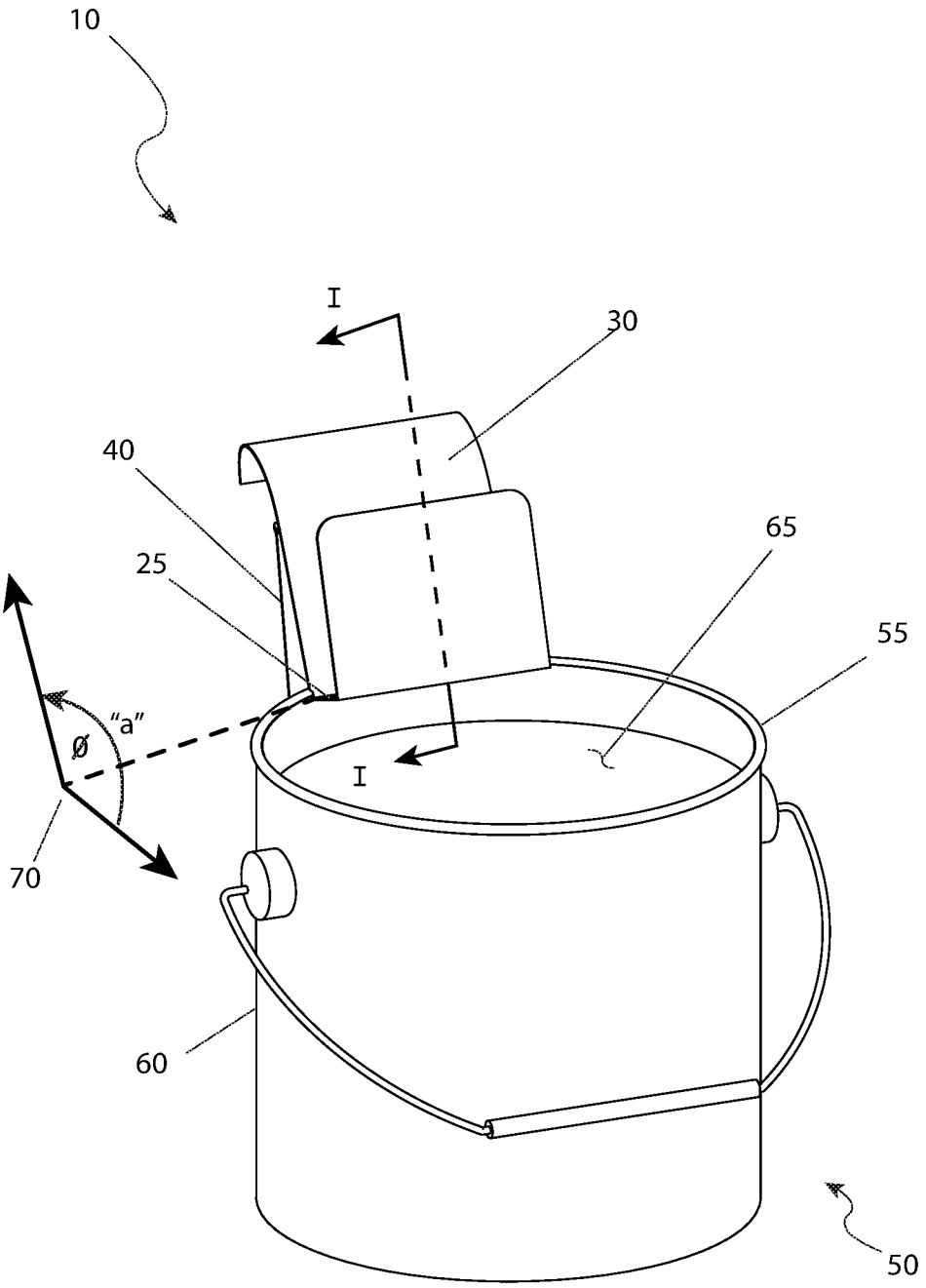
FIG. 2 is a perspective view of the brush holder 10, shown in an installed state on a paint can 50, according to the preferred embodiment of the present invention.

Referring next to FIG. 2, a perspective view of the device 10, shown in an installed state on a paint can 50, according to the preferred embodiment of the present invention is depicted. The device 10 is positioned such that the rearward side of the curved rear support 30 and the forward side of the rear brace 40 hold captive the rim 55 and the side surface 60 of the paint can 50. This configuration places the bottom grated surface 25 over the paint 65 such that excess paint 110 can drip back into the paint can 50. The position of the curved rear support 30 with respect to the surface of the paint 65 is defined by a displacement angle "a" 70 and is controlled by an adjustment mechanism 75 (not shown in this FIGURE due to illustrative limitations) and will be described in greater detail herein below. It is envisioned that the use may wish to adjust the displacement angle "a" 70 to compensate for multiple environmental factors including but not limited to: position of the paint can 50 with regard to location of work, type of paint 65, amount of paint 65 remaining in the paint can 50, size of the paint brush 95 and the like.

Figure 3:
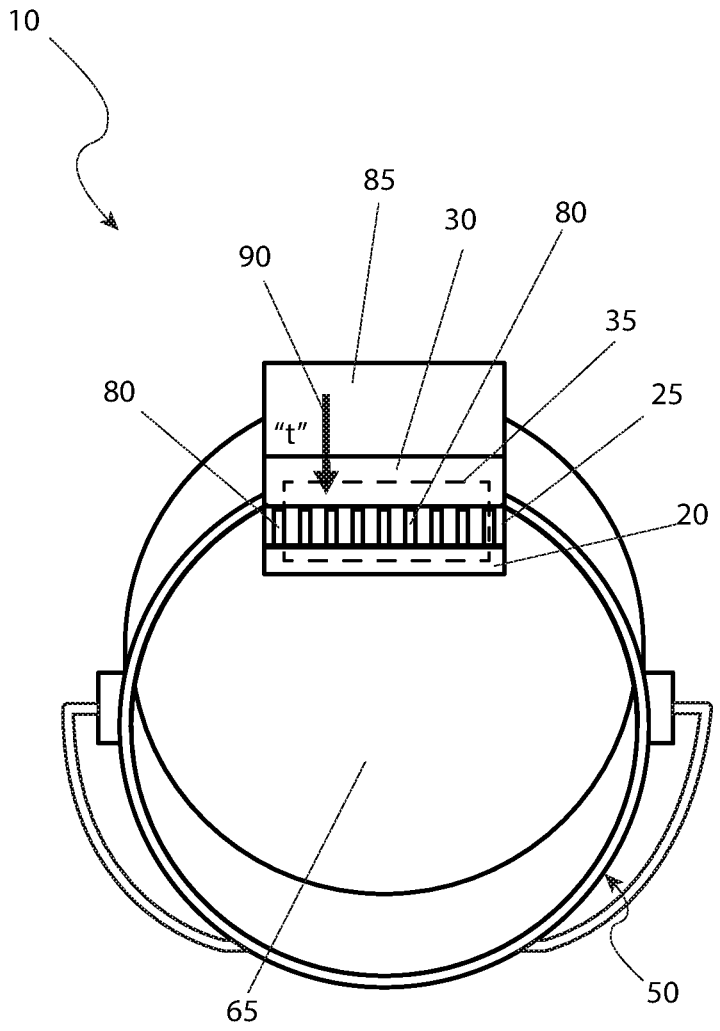
FIG. 3 is a top view of the brush holder 10, shown in an installed state on a paint can 50, according to the preferred embodiment of the present invention.

Referring now to FIG. 3, a top view of the device 10, shown in an installed state on a paint can 50, according to the preferred embodiment of the present invention is shown. This figure clearly discloses the grated surface 25 and its position over the paint 65 contained within the paint can 50. The grated surface 25 is provided with multiple open slots 80 that allow any excess paint 65 within the holding cavity 35 formed by the curved rear support 30 and the forward stop 20 to return the paint can 50 via gravity. As such, the holding cavity 35 remains clear. The upper surface of the curved rear support 30 is provided with a rolled edge 85 to allow for easy insertion and removal of a paint brush, as will be shown in greater detail herein below. It is also envisioned that the rolled edge 85 may be used to wipe excess paint 65 off of the paint brush 95 after dipping the bristles 100 in the paint 65. Any excess paint 65 that is removed will flow down the surface of the curved rear support 30 as indicated by a travel path "t" 90, whereupon contacting the grated surface 25, and transition into dripping paint 110 to flow through the open slots 80 of the grated surface 25 and return to the paint can 50.

Figure 4:
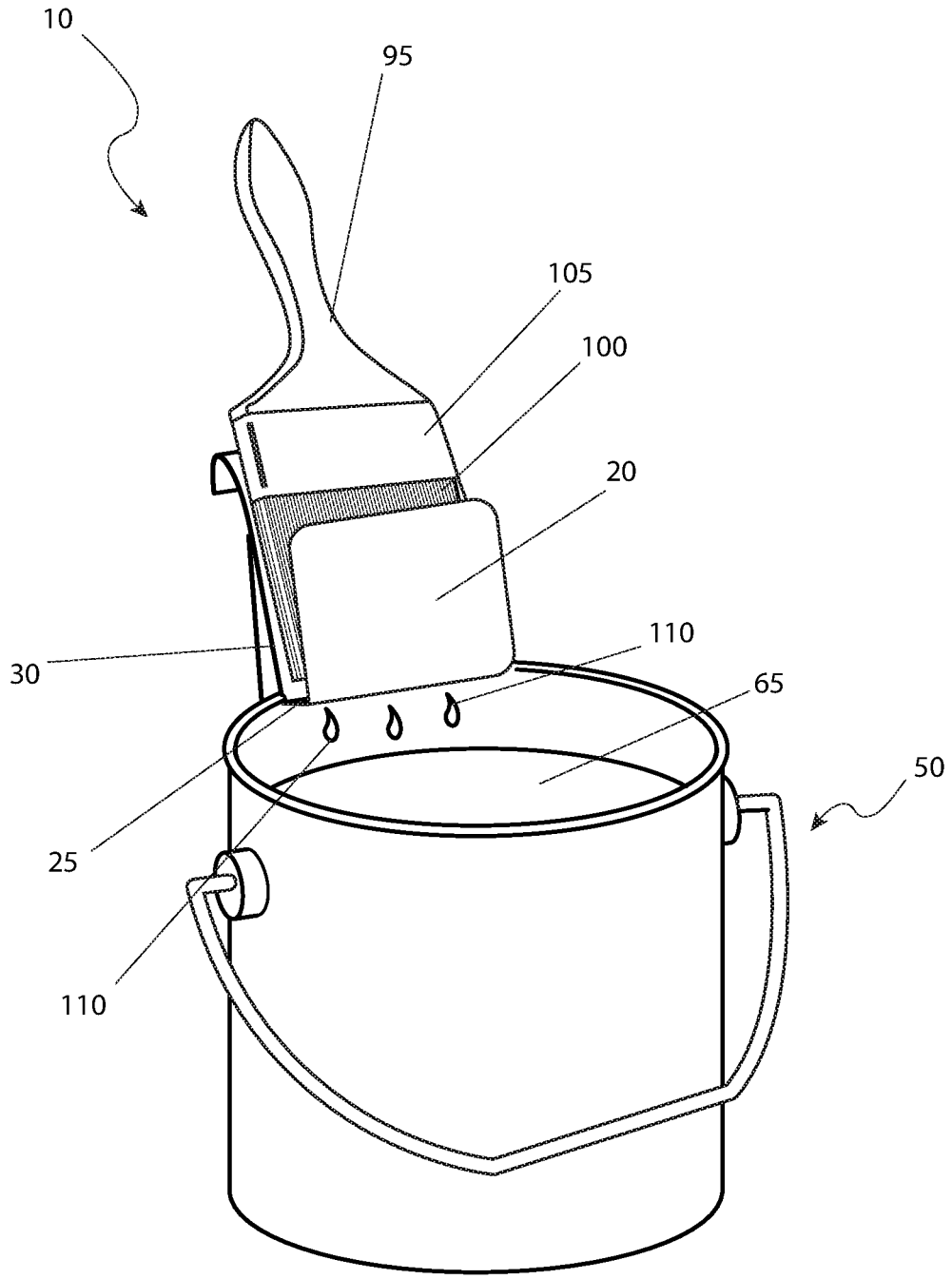
FIG. 4 is a perspective view of the brush holder 10, shown in a utilized state with a paint brush 95, according to the preferred embodiment of the present invention; and, FIG. 5 is a sectional view of the brush holder 10, as seen along a line I-I, as shown in FIG. 2, according to the preferred embodiment of the present invention.

Referring next to FIG. 4, a perspective view of the device 10, shown in a utilized state with a paint brush 95, according to the preferred embodiment of the present invention is disclosed. The bristles 100 of the paint brush 95 are positioned such that their tip is at the junction of the forward stop 20 and the grated surface 25. The ferrule 105 of the bristles 100 is positioned such that it contacts the curved rear support 30 and remains in place via friction and gravity. It is envisioned that a paint brush 95 up to the width of the frame 15 as well as even slightly larger may be used with the device 10. The paint brush 95 is positioned in the device 10 during times when the paint brush 95 is not in use, but use will resume shortly. These times are envisioned to include, breaks, preparation work, attending to personal manner, or the like. The use of the device 10 provides multiple benefits over conventional storage locations such as on a drop cloth, over the edge of a paint can 50, cantilevered of the edge of a step of a ladder or the like. Benefits are envisioned to include, keeping the handle of the paint brush 95 clear of dripped paint, allowing for any surplus paint 110 to drip back into the paint can 50, a commonly recurring storage space such that time is not wasted looking for the paint brush 95 when painting resumes and the like. This configuration allows for dripping paint 110 to the return into the paint can 50. The conservation of paint 65 result in overall savings as well as reduced ecological impact due to paint 65 in waste streams.

Figure 5:
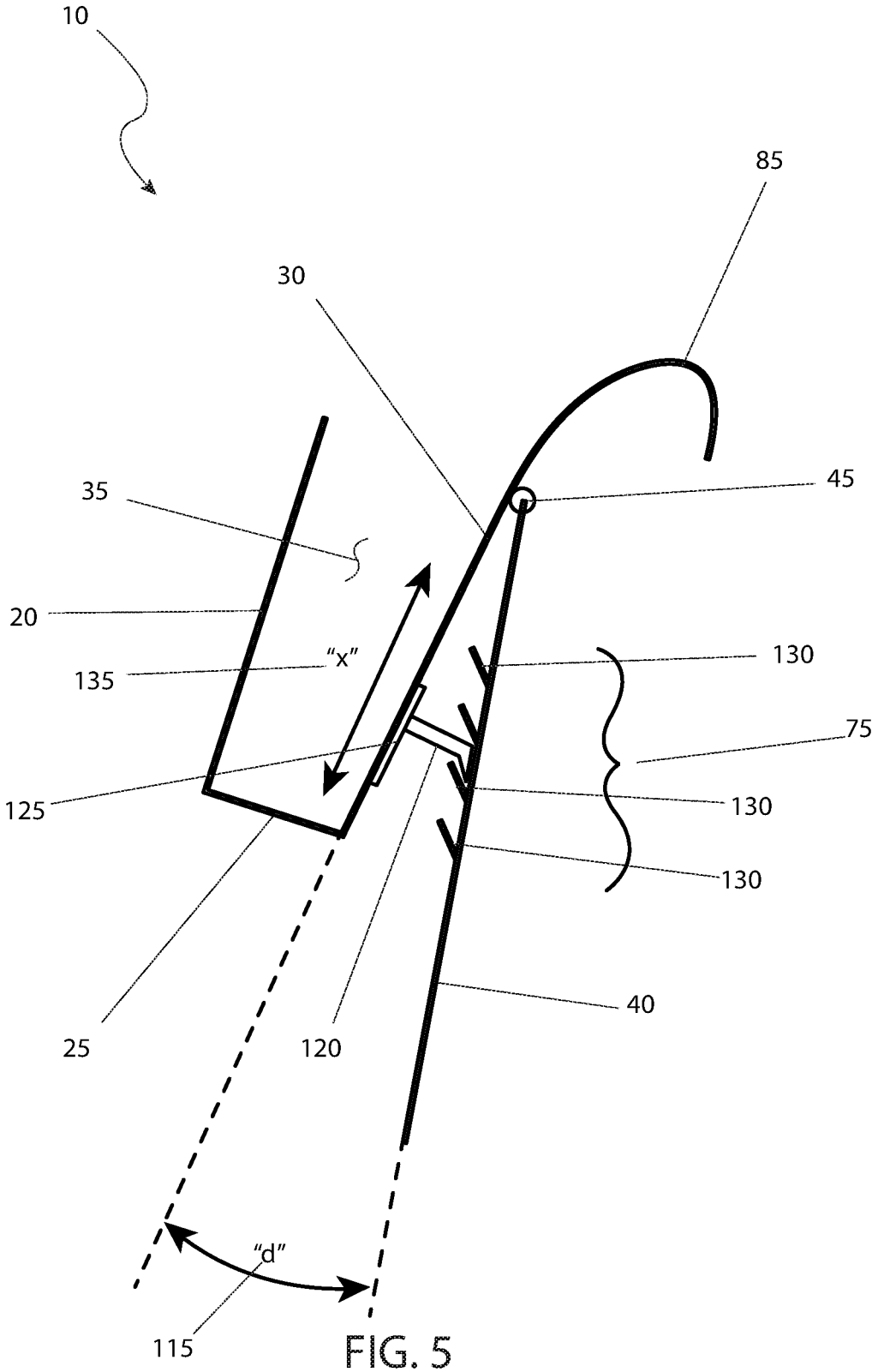

Referring finally to FIG. 5, a sectional view of the device 10, as seen along a line I-I, as shown in FIG. 2, according to the preferred embodiment of the present invention is depicted. This figure clearly illustrates the holding cavity 35 as formed by the forward stop 20, the grated surface 25, and the curved rear support 30, as well as the rolled edge 85 located at the uppermost edge of the curved rear support 30. The rear brace 40, working in conjunction with the curved rear support 30 and the hinge assembly 45 form a displacement angle "d" 115. The hinge assembly 45 may use a pin, a piano hinge mechanism, a flexible plastic area, or other similar means to produce motion. The use of any specific type of hinge assembly 45 is not intended to be a limiting factor of the present invention. The displacement angle "d" 115 is maintained by the use of the adjustment mechanism 75. The adjustment mechanism 75 is envisioned to include a center mounted adjustment arm 120, a sliding track 125 and multiple adjustment stops 130. Before placing the device 10 on a paint can 50, (as shown in FIG. 2), they would adjust the center mounted adjustment arm 120 within the sliding track 125, by sliding it along a travel path "x" 135 and engaging the distal end of the center mounted adjustment arm 120 within one (1) of the adjustment stops 130. It is noted that other types and styles of adjustment mechanism 75, including but not limited to: threaded rods, extendable rods, angled arms, and the like could be used with equal effectiveness, and as such, the use of any particular style of adjustment mechanism 75 should not be interpreted as a limiting factor of the present invention.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 through normal procurement channels such as paint supply stores, home improvement stores and the like, while paying particular attention to specifics such as overall size of the paint can 50 as well as the overall size of the paint brush 95 to be used with the device 10.

After procurement and prior to utilization, the device 10 would be prepared in the following manner: the user would manipulate the rear brace 40 with respect to the curved rear support 30 with the aid of the hinge assembly 45 and the adjustment mechanism 75, depending on the exact usage of the device 10; the device 10 would then be placed over the rim 55 of the paint can 50.

During utilization of the device 10, the following procedure would be initiated: during periods of time where the user is not actively using the paint brush 95, it would be placed in the holding cavity 35 of the device 10 as indicated in FIG. 4; excess paint 65 would flow off the paint brush 95 via gravity, transition into dripping paint 110, and fall within the open slots 80 of the grated surface 25 and into the paint can 50 where it can be used without waste.

After use of the device 10, it is removed from the paint can 50 and washed with soap and hot water or the appropriate solvent depending on the type of paint 65 used; it may then be re-used at a future date in a continually repeating process.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A brush holder for a paint can, comprising: a "U"-shaped frame having a forward stop, said frame provides a holding cavity for holding a paint brush in an upright condition, said paint brush having a plurality of bristles, each of said bristles having a tip and connected to a ferrule; a bottom grated surface over a paint can such that a plurality of excess paint drips back into said paint can; a curved rear support having an upper surface, said upper surface is provided with a rolled edge to allow for easy insertion and removal of a paint brush; and a rear brace connected to a rear side of said curved rear support via a hinge assembly, said rear brace is configured to provide additional stability to said frame when said brush holder is placed atop an open can of a paint; wherein said ferrule of each said bristle is positioned such that it contacts said curved rear support and remains in place via friction and gravity; wherein said grated surface is provided with a plurality of open slots that allow any said excess paint within said holding cavity formed by said curved rear support and said forward stop to return said paint can via gravity; wherein said hinge assembly uses a pin, a piano hinge mechanism, or a flexible plastic area to produce motion; wherein said upper surface of said curved rear support is provided with said rolled edge to allow for easy insertion and removal of said paint brush, wherein said excess paint that is removed will flow down said curved rear support contacting a grated surface and transition into a plurality of dripping paint to flow through said open slots of said grated surface and return to said paint can; wherein said paint brush is equal or larger than a width of said frame; wherein said rolled edge is to wipe said excess paint off of said paint brush after dipping said bristles in said paint; wherein position of said curved rear support is defined by a displacement angle and is controlled by an adjustment mechanism, and wherein said adjustment mechanism includes a center mounted adjustment arm, a sliding track and a plurality of adjustment stops.

2. The brush holder according to claim 1, wherein said brush holder is made of plastic.

3. The brush holder according to claim 1, wherein said paint can is 1 gallon.

4. The brush holder according to claim 1, wherein said forward stop is two and a half inches tall.

5. The brush holder according to claim 1, wherein said bottom grated surface is one-half inch deep.

6. The brush holder according to claim 1, wherein said curved rear support is three and three-quarters inches tall.

7. The brush holder according to claim 1, wherein said forward stop is four inches wide.

8. The brush holder according to claim 1, wherein said bottom grated surface is four inches wide.

9. The brush holder according to claim 1, wherein said curved rear support is four inches wide.

* * * * *